US005938143A

United States Patent [19]

Yukitake

[11] Patent Number: 5,938,143

[45] Date of Patent: Aug. 17, 1999

[54] IGNITION COIL BANK-WINDING METHOD

[75] Inventor: Kikuo Yukitake, Tsurugashima, Japan

[73] Assignee: Toyo Denso Kabushiki Kaisha, Tokyo, Japan

[21] Appl. No.: 09/022,499

[22] Filed: Feb. 13, 1998

[30] Foreign Application Priority Data

Feb. 19, 1997 [JP] Japan ..... 9-074317
Feb. 19, 1997 [JP] Japan ..... 9-074319

[51] Int. Cl.[6] ..... B21C 47/10

[52] U.S. Cl. ..... 242/447; 242/447.1; 242/479.4

[58] Field of Search ..... 242/447, 419.1, 242/419.9, 447.1, 479.4, 479.5, 479.6

[56] References Cited

U.S. PATENT DOCUMENTS

| | | | |
|---|---|---|---|
| 1,236,906 | 8/1917 | Calkins | 242/479.6 |
| 1,268,905 | 6/1918 | White | 242/479.6 |
| 2,247,718 | 7/1941 | Treckmann | 242/473.8 |
| 2,303,298 | 11/1942 | Early | 242/479.5 |
| 2,602,607 | 7/1952 | Calvi | 242/483.5 |
| 3,003,716 | 10/1961 | Davis et al. | 242/154 |
| 3,565,357 | 2/1971 | Noguchi | 242/25 |
| 3,779,480 | 12/1973 | Cambou | 242/158 R |
| 4,428,540 | 1/1984 | Calcagno et al. | 242/25 R |

*Primary Examiner*—Donald P. Walsh
*Assistant Examiner*—Minh-Chau Pham
*Attorney, Agent, or Firm*—Lyon & Lyon LLP

[57] ABSTRACT

An ignition coil winding method for spirally winding an element wire in conical banks of wire turns one by one around a coil bobbin provides in particular that a nozzle can vertically move toward and away from the coil bobbin according to a changing winding radius and can swing in the direction normal to the longitudinal axis of the bobbin to maintain constant tension of the element wire. This method also uses a nozzle whose opening diameter is 2 to 6 times larger than that of the element wire to eliminate oscillation of the element wire in the nozzle opening.

14 Claims, 3 Drawing Sheets

IGNITION COIL BANK-WINDING METHOD

BACKGROUND OF THE INVENTION

The present invention relates to a method of winding a secondary coil of an engine igniting coil device.

Japanese laid-open patent No. 60-107813 discloses a bank winding method applied for manufacturing a secondary coil of a compact engine ignition coil device having a necessary dielectric strength of the coil interlayer insulation. According to this bank winding method, an element wire being fed from a nozzle reciprocating in the coil winding direction for a distance of a specified width is suitably tensioned and wound spirally in banks of turns one by one in both forward and reverse directions on a coil bobbin coaxially connected to a rotating shaft.

The conventional bank winding method forms a coil on a coil bobbin by winding an element wire in layers around the bobbin in both forward and reverse directions by the reciprocal movement of the nozzle in parallel to the longitudinal axis of the bobbin. Consequently, a nozzle-to-bobbin distance (distance from a nozzle tip to a bending point of an element wire to form a new turn of a coil on the bobbin) and a wire-to-nozzle angle (angle formed by the element wire with the nozzle outlet axis) varies according to the changing radius of a coil being formed on the bobbin, causing fluctuation of tension in the element wire.

In short, the conventional bank winding method applied for manufacturing an engine ignition coil device has the following problems to be solved.

The first problem of the conventional bank winding method for winding an element wire in banks of turns around a coil bobbin by using a nozzle reciprocating parallel to the longitudinal axis of the coil bobbin is that the nozzle-to-bobbin distance and the wire-to-nozzle angle vary and make the tension of the wire unstable, resulting in loosening and/or falling-down of wire turns of the coil.

The second problem is that the conventional bank-winding method may be accompanied by a remarkable variation of the nozzle-to-bobbin distance and the wire-to-nozzle angle, in particular, when winding a tensioned fine element wire (e.g., a wire of 0.05 to 0.07 mm in diameter) in banks of turns one over another around the coil bobbin in both forward and backward directions. In this case, the fine wire unsteadily oscillates in a relatively large outlet of the nozzle, causing the falling-down of the turns in the coil being formed on the bobbin.

SUMMARY OF THE INVENTION

In view of the foregoing, the present invention is made to provide an improved bank winding method of forming a secondary coil on a secondary coil bobbin for an engine igniting coil, by which an element wire being fed with constant tension through a nozzle head reciprocally moving a specified distance along the rotation axis of the coil bobbin is spirally wound in conical layers of wire turns one by one at a specified pitch around the coil bobbin coaxially attached to a rotating shaft in such a way that the nozzle-to-bobbin distance and the wire-to-nozzle angle may be always constant by axially moving the nozzle toward and away from the bobbin according to a changing winding radius and by swinging the wire in the direction normal to the nozzle axis, thus preventing the banks of wire turns from being loosened and falling-down during the winding operation.

According to the present invention, it is possible to use a nozzle whose outlet opening has a diameter 2 to 6 times larger than that of an element wire to be wound into a coil.

DESCRIPTION OF THE PREFERRED EMBODIMENTS

The preferred embodiments of the present invention will be described in detail by way of example and with reference to the accompanying drawings.

Figure 1:
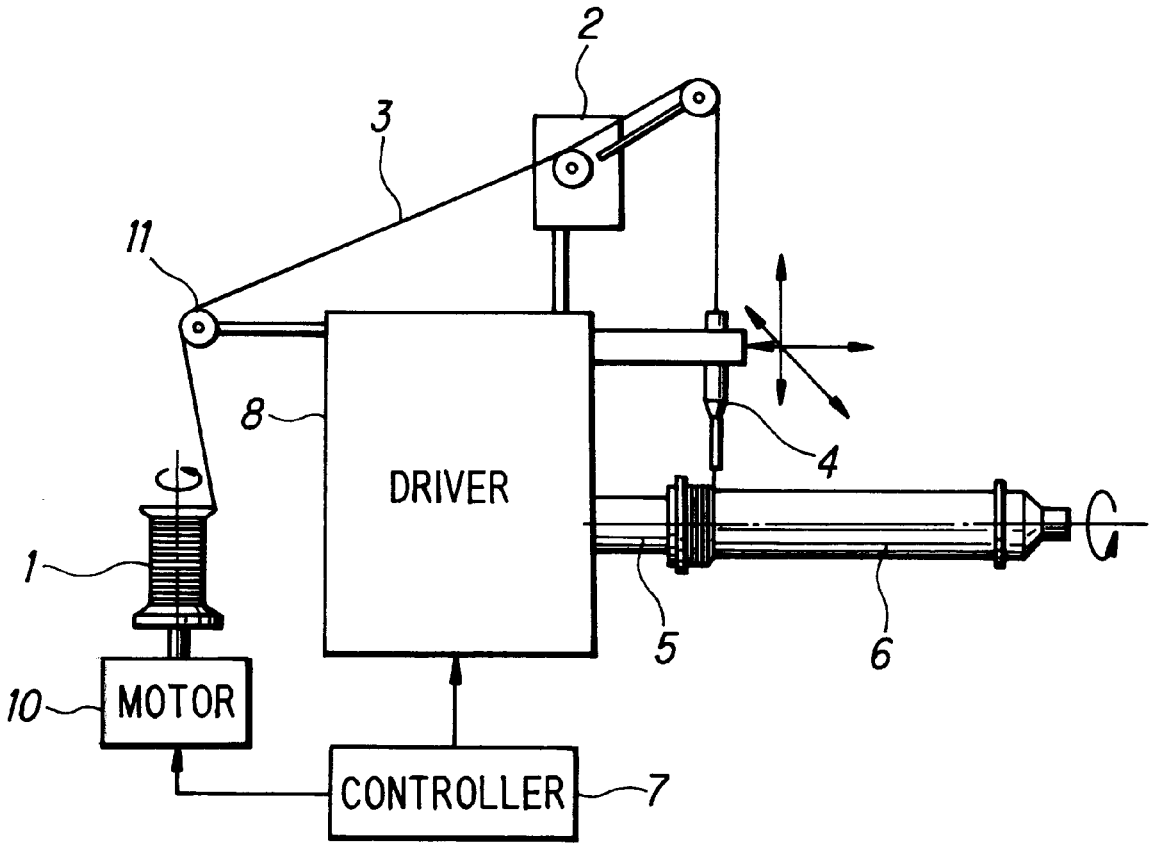
FIG. 1 is a side view of a coil winding machine for bank winding of an engine igniting coil according to the present invention.
Figure 2:
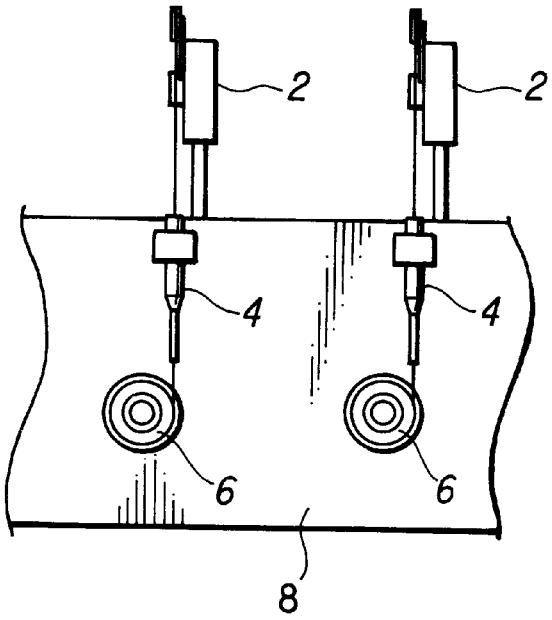
FIG. 2 is a front view of the coil winding machine of FIG. 1.
Figure 3:
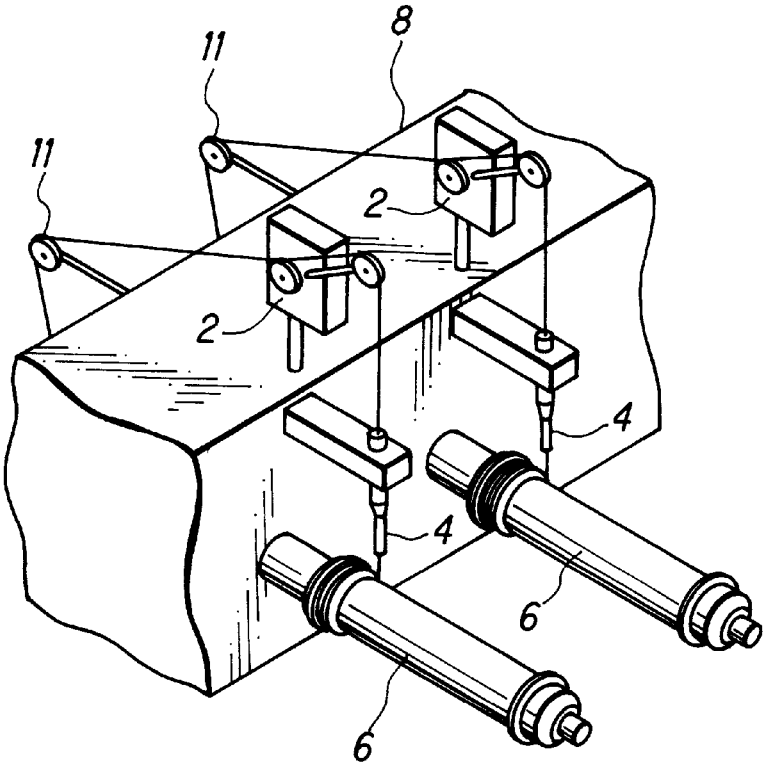
FIG. 3 is a perspective view of the coil winding machine of FIG. 1.

FIGS. 1 to 3 are illustrative of an example of coil winding machine for realizing the bank winding of an engine ignition coil by the bank winding method according to the present invention. The shown machine is of multi-unit type that is capable of simultaneously forming a plurality of engine ignition coils.

The operation of each coil winding unit of the machine is as follows:

An element wire 3 being fed from a spool 1 through a tensioning device 2 and a nozzle 4 reciprocating in the coil winding direction for a distance of a specified width is spirally wound in conical banks of turns one by one in both forward and reverse directions to form a coil on a rotating coil bobbin 6 coaxially attached to a rotating shaft 5 which is driven by driver 8 under the control of a controller 7.

Figure 4:
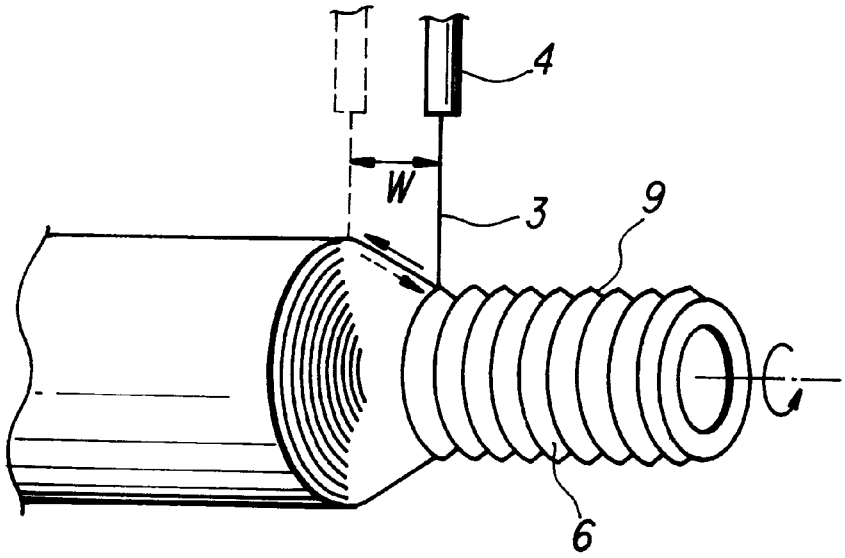
FIG. 4 is a perspective view for explaining a method of bank winding of a coil according to the present invention.

FIG. 4 shows the coil forming process in which an element wire 3 is wound in conical banks of wire turns one by one around a coil bobbin 6 in the forward direction of ascending (upward slope) bank-winding with an increasing winding diameter and the reverse direction of descending (downward slope) bank-winding with a decreasing winding diameter by driving a nozzle 4 to reciprocally move a specified distance of width "w" corresponding to a bank length at a specified pitch.

The bobbin 6 has a plurality of fine grooves 9 formed in an axial direction on its body for preventing collapse of banks of wire turns.

Figure 5:
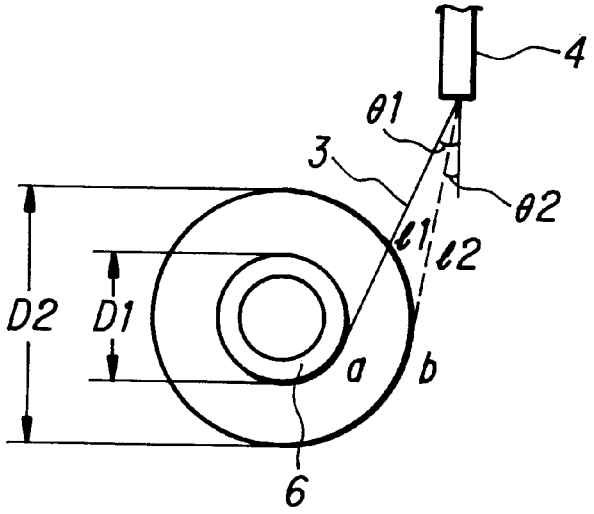
FIG. 5 is an end view for explaining a method of bank winding of a coil according to the present invention.

As shown in FIG. 5, a coil being formed on a coil bobbin 6 by spirally winding thereon an element wire 3 varies its diameter from a least diameter D1 to a maximum diameter D2, whereby the element wire 3 may have different lengths l1 and l2 (distances from a nozzle 4 to wire bending points "a" and "b" on the bank-winding section) and different angles θ1 and θ2 formed by the wire with the axis of the nozzle 4 at the least winding diameter D1 and the maximum winding diameter D2 respectively.

Consequently, the bank winding of an element wire around the coil bobbin by the nozzle 4 simply reciprocating along the longitudinal axis of the bobbin is accompanied by variation of the nozzle-to-bobbin distance l and the wire-to-nozzle angle θ. This causes the element wire to vary its tension, resulting in loosening and/or falling-down of wire turns in the coil formed.

Therefore, the method according to the present invention includes vertically moving the nozzle 4 toward and away from the coil bobbin in synchronism with winding of the element wire around the bobbin under the control of the controller 7 so that the distance l from the nozzle 4 to the wire bending point may be maintained always at a constant specified value.

The nozzle 4 also swings from left to right and the reverse in synchronism with winding of the element wire around the bobbin under the control of the controller 7 so that the angle θ of the element wire to the nozzle axis may be maintained always at a constant specified value.

The nozzle 4 can move vertically and transversely to always maintain the constant distance l and the constant angle θ of the element wire, thus assuring feeding the element wire 3 with a constant tensioning force. This can effectively prevent loosening of wire turns and/or falling-down of the banks in the coil formed on the bobbin 6.

Usually, an element wire 3 is coated with oil to be smoothly fed from the spool 1 by the effect of a drawing force from the winding side. The winding method according to the present invention is intended to use an element wire 3 that is not coated with oil to prevent the collapse of banks resulted from slip-down of wire turns therein during the process of spirally winding the wire around the bobbin.

To smoothly feed the not-oil-coated element wire 3, the spool 1 is provided with a motor 10 for rotating the spool 1 in synchronism with winding the coil wire around the bobbin under the control of the controller 7.

Between the spool 1 and the tensioning device 2, a cushion roller 11 is disposed to absorb the shock that may be produced when drawing the element wire 3 from the spool 1.

The combination of the rotatable spool 1 with the cushioning roller 11 allows the element wire 3 to be fed always with constant tension, making it possible to form a reliable coil on the bobbin with no loosening of wire turns and/or no collapse of the banks of the wire turns thereof.

The process of spirally winding an element wire 3 in layers one by one in both forward and backward directions also provides that the number of wire turns in banks in the reverse direction of descending spiral winding with a decreasing winding diameter is larger than that in the forward direction of ascending spiral winding with an increasing winding diameter.

Namely, a coil may be formed on the coil bobbin by placing thereon, for example, 50 turns of the element wire in conical banks in the forward winding direction and 53 to 58 turns of the wire in conical banks in the reverse winding direction.

This method can form a reliable foundation of a bank slope by placing a larger number of turns on the coil bobbin in the reverse descending winding direction and by further spiral winding the wire over the upward slope of firmly wound banks, thus preventing the occurrence of falling-down of the wire turns during the winding operation.

This design solution in combination with the before-described means for maintaining constant tension in the element wire to be wound on the bobbin has an increased effect to prevent collapse of the conical banks of wire turns.

As shown in FIG. 4, the bobbin is provided with a plurality of fine grooves in which an increase of wire turns in the forward winding direction is accommodated to effectively prevent collapse of the banks of wire turns.

The method according to the present invention uses a nozzle 4 whose opening diameter is 2 to 6 times larger than that of an element wire 3.

For example, an element wire of 0.05 mm in diameter is fed through a nozzle having an outlet opening of 0.1 to 0.3 mm in diameter.

Thus, the nozzle 4 allows the element wire 3 to smoothly pass through its outlet at the least necessary clearance that may also prevent the oscillation of the wire therein while being wound spirally in layers one over another in both forward and reverse directions on the coil bobbin 6.

As is apparent from the foregoing, the ignition coil winding method according to the present invention can form a reliable coil on a coil bobbin with no collapse of banks of wire turns by winding an element wire spirally in conical layers one by one around the coil bobbin in both forward and reverse direction thereon in such a way that the nozzle-to-bobbin distance and the wire-to-nozzle angle may be always maintained at constant specified values by axially moving the nozzle toward and away from the bobbin according to a changing winding radius and by swinging the wire in the direction normal to the nozzle axis, thus realizing adaptively winding the wire around the bobbin with a constant tension and with no fear of loosening and falling-down of the banks of wire turns in the coil during the winding operation.

This method is featured by the fact that the number of wire turns in the reverse direction of descending spiral winding with a decreasing winding diameter is larger than that in the forward direction of ascending spiral winding with an increasing winding diameter. The method can form a reliable foundation of a bank slope by placing a larger number of turns on the coil bobbin in the reverse descending winding direction and by further spiral winding the wire over the upward slope of firmly wound banks, thus preventing the occurrence of falling-down of the wire turns during the winding operation.

The winding method according to the present invention is intended to use a not-oil-coated element wire 3 that can be smoothly uncoiled from a rotatable spool being protected against a shock by a cushion member. The combination of the rotatable spool with the cushion roller allows the not-oil-coated element wire to be fed always with a constant tension. This makes it possible to winding a coil on the bobbin with no loosening of wire turns and/or no collapse of the banks of the wire turns.

The ignition coil bank-winding method according to the present invention uses a nozzle whose outlet opening has a diameter being 2 to 6 times larger than the diameter of an element wire, thus the nozzle allows the element wire to smoothly pass through the nozzle at the least necessary clearance that may also prevent the oscillation of the wire therein while being wound spirally in layers one over another in both forward and backward directions on the coil bobbin. This can effectively prevent collapse of banks of wire turns during the coil forming process.

What is claimed is:

1. A method of bank winding of an engine igniting coil, by which an element wire tensioned with a specified force by a tensioning device is fed from a nozzle reciprocating for a specified distance at a specified pitch along a longitudinal axis of a coil bobbin and wound spirally in layers of wire turns one over another in forward and reverse directions on the coil bobbin coaxially attached to a rotating shaft, wherein the nozzle is also movable toward and away from the coil bobbin to always maintain a constant distance from the nozzle to a current winding point of the element wire to form a new turn of a coil on the bobbin.

2. A method of bank winding of an engine igniting coil, by which an element wire tensioned with a specified force by a tensioning device is fed from a nozzle reciprocating for a specified distance at a specified pitch along a longitudinal axis of a coil bobbin and wound spirally in layers of wire turns one over another in forward and reverse directions on the coil bobbin coaxially attached to a rotating shaft, wherein the nozzle swings in a direction perpendicular to the longitudinal axis of the coil bobbin to always maintain a constant angle between the element wire and the nozzle axis.

3. A method of bank-winding of an engine igniting coil as defined in claim 1 or 2, characterized in that a spool for supporting and supplying the element wire is rotated by a motor in synchronism with a rate of feeding of feeding of the element wire onto the bobbin.

4. A method of bank-winding of an engine igniting coil as defined in claim 3, characterized in that a cushion member for absorbing a shock produced when drawing the element wire from the spool is provided between the spool and the tensioning device.

5. A method of bank-winding an engine igniting coil, by which an element wire tensioned with a specified force is fed through a nozzle and wound spirally in layers of wire turns one over another in both forward and backward directions on a coil bobbin coaxially attached to a rotating shaft, wherein the nozzle has a wire exit opening whose diameter is 2–6 times larger than that of the element wire fed through the wire exit opening.

6. A method of bank-winding of an engine igniting coil as defined in claim 5, characterized in that a spool for supplying the element wire is rotated by a motor in synchronism with a rate of feeding the element wire onto the bobbin.

7. A method of bank-winding of an engine igniting coil as defined in claim 7, characterized in that a cushion member for absorbing a shock produced when drawing the element wire from the spool is provided between the spool and the tensioning device.

8. A method of bank-winding of an engine igniting coil as defined in claim 1 or 2, wherein the nozzle has a wire exit opening whose diameter is 2–6 times larger than that of the element wire fed through the wire exit opening.

9. A method of bank winding of an engine igniting coil, comprising the steps of tensioning an element wire and feeding the element wire through a nozzle reciprocating for a specific distance at a specific pitch along a longitudinal axis of a coil bobbin and spirally winding the element wire in conical layers of wire turns one over another in forward and reverse axial directions on the coil bobbin coaxially attached to a rotating shaft, and also synchronously moving the nozzle with respect to the coil bobbin for maintaining a constant tension on the element wire to form uniformly tensioned turns of a coil on the bobbin.

10. A method of bank-winding of an engine igniting coil as defined in claim 9, wherein the nozzle is swung in a direction perpendicular to the longitudinal axis of the coil bobbin for maintaining a constant angle between the element wire and an axis of the nozzle for maintaining said constant tension.

11. A method of bank-winding of an engine igniting coil as defined in claim 9 or 10, wherein the nozzle is movable toward and away from the coil bobbin for maintaining a constant distance from the nozzle to a current winding point of the element wire to form a new turn of a coil on the bobbin for maintaining said tension.

12. A method of bank-winding of an engine igniting coil as defined in claim 9 or 10, characterized in that a spool for supplying the element wire is rotated by a motor in synchronism with a rate of feeding the element wire.

13. A method of bank-winding of an engine igniting coil as defined in claim 12, characterized in that a cushion member for absorbing a shock produced when drawing the element wire from the spool is provided between the spool and the tensioning device.

14. A method of bank-winding of an engine igniting coil as defined in claim 9 or 10, wherein the nozzle has a wire exit opening whose diameter is 2–6 times larger than that of the element wire fed through the wire exit opening.

* * * * *